US005492246A

United States Patent [19]

Bailey

[11] Patent Number: 5,492,246

[45] Date of Patent: Feb. 20, 1996

[54] CUP HOLDER WITH COUNTER ASSEMBLY

[76] Inventor: Frederick N. Bailey, 4544 Acacia Ave., La Mesa, Calif. 91941

[21] Appl. No.: 304,397

[22] Filed: Sep. 12, 1994

[51] Int. Cl.[6] ..... B65D 85/00; G09F 3/00

[52] U.S. Cl. ..... 220/756; 40/324; 116/315; 206/459.1; 220/737

[58] Field of Search ..... 116/315, 311, 116/309, 306; 229/402, 404, 406; 220/737–742, 756; 206/217, 459.1; 40/324

[56] References Cited

U.S. PATENT DOCUMENTS

| | | | |
|---|---|---|---|
| 1,113,618 | 10/1914 | Haldeman | 220/738 |
| 2,874,672 | 2/1959 | Hamm, Jr. | 116/315 X |
| 4,037,719 | 7/1977 | Perlmutter | 206/459.1 X |
| 4,573,580 | 3/1986 | Messer | 206/459.1 X |
| 4,720,023 | 1/1988 | Jeff | 220/739 X |

FOREIGN PATENT DOCUMENTS

| | | | |
|---|---|---|---|
| 592928 | 5/1925 | France | 40/324 |

*Primary Examiner*—Bryon P. Gehman
*Attorney, Agent, or Firm*—Charles C. Logan, II

[57] ABSTRACT

A cup holder with structure for counting the number of glasses of water drunk daily. It has a tubular body having an open top end for removably receiving a drinking cup. A C-shaped handle extends from the rear end of the tubular body. A counter assembly is mounted in the top end of the handle. The counter assembly has a disc and numbers from 0–10 are spaced around the perimeter of its front face. The disc has a shaft extending from its front and rear walls for allowing the disc to be rotated about a horizontal axis. The number displayed at a window recess would indicate the number of glasses of water drunk that day.

6 Claims, 1 Drawing Sheet

CUP HOLDER WITH COUNTER ASSEMBLY

BACKGROUND OF THE INVENTION

The invention relates to a cup holder and more specifically a cup holder having a counter assembly for counting the number of glasses of water drunk daily by a person.

Current information on health care indicates that people should drink from 2 to 8 glasses of water daily in order to help flush the body's system. People trying to follow this health tip often have a difficult time keeping track of how many glasses of water they drank during the day. This is very disconcerting and often adds anxiety to the person trying to be faithful in drinking the required number of glasses of water.

There are also many diets recommended by doctors or set forth in books that extol the virtue of drinking a considerable amount of water daily for the purpose of flushing their system. Some people try to keep a record of each time they drink a cup of water. This is a bothersome and annoying system.

It is an object of the invention to provide a novel cup holder that incorporates structure for counting the number of glasses of water a person drinks daily.

It is also an object of the invention to provide a novel cup holder that is economical to manufacture and market.

It is another object of the invention to provide a novel cup holder which allows a person to determine at a glance how many glasses of water they drank that day.

SUMMARY OF THE INVENTION

The novel cup holder would preferably be formed of plastic material and it would be molded in two halves. The cup holder has a tubular body having a bottom wall and it removably receives a cup such as an 8 ounce drinking cup. A C-shaped handle is formed on the rear end of the cup holder.

The structure for counting the number of glasses of water drunk daily is mounted in the counter assembly compartment of the handle. The counter assembly has a disc having a front wall and a rear wall. A shaft extends perpendicular from the respective front and rear walls and it lies on a horizontal axis. The interior of the respective right and left side walls of the counter assembly compartment have tubular bosses extending inwardly that receive the respective shafts of the disc and provides structure that allows the disc to be rotated.

The disc has the numbers 0–10 marked around an outer radius of the front face. The disc has a plurality of protrusions extending around its entire perimeter to aid in gripping the disc for rotational purposes. There is a cut out slot in the disc and a ratchet finger formed on the disc extends partly into the cutout slot. The ratchet finger has a dog or protrusion that travels along the inner surface of an annular boss extending out from the side wall. There are notches formed on the inner surface of the annular boss and the dog or protrusion rides in and out of the notches to positively lock the disc at it's respective numbers. The left side of the counter assembly compartment has a window recess formed adjacent its top end that allows the number on the disc to be viewed which indicates the number of cups that were drunk.

DESCRIPTION OF THE PREFERRED EMBODIMENT

Figure 1:
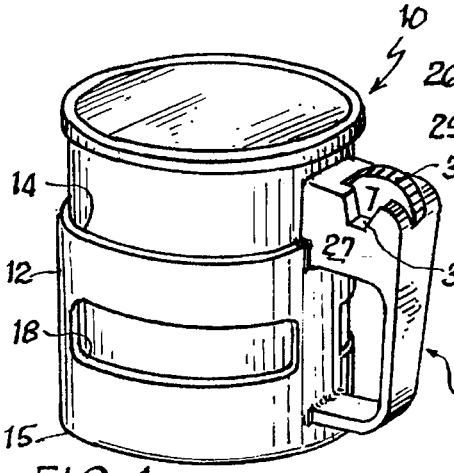
FIG. 1 is a left side perspective view of the novel cup holder in combination with a cup.
Figure 2:
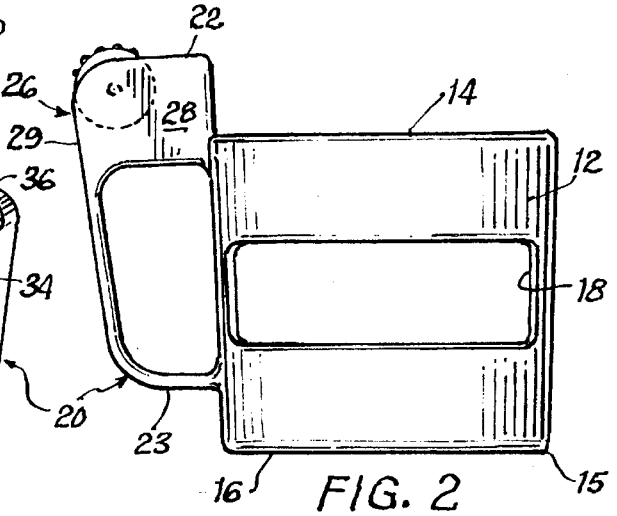
FIG. 2 is a right side elevation view of the novel cup holder.
Figure 3:
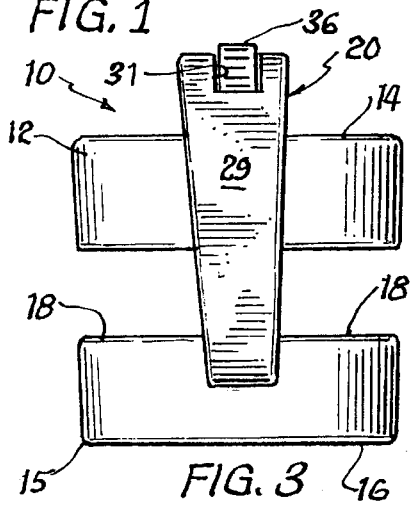
FIG. 3 is a rear elevation view of the novel cup holder.
Figure 4:
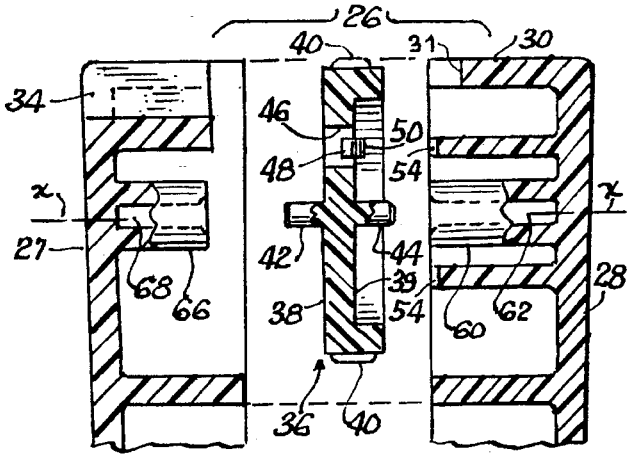
FIG. 4 is an enlarged exploded cross sectional view of the counter assembly compartment.
Figure 5:
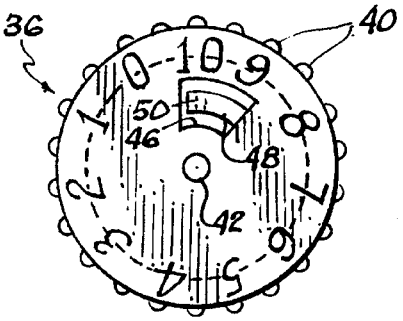
FIG. 5 is an enlarged left side elevation view of the disc.
Figure 6:
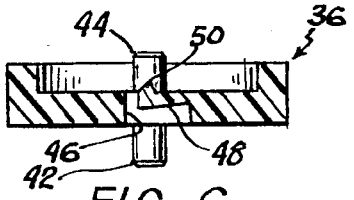
FIG. 6 is an enlarged cross section view of the disc.
Figure 7:
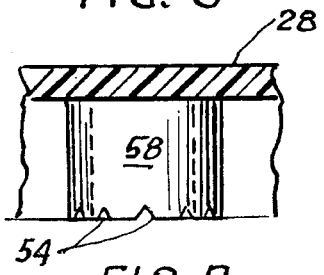
FIG. 7 is an enlarged top plan view of the annular boss on the right side wall of the counter assembly compartment.

The novel cup holder with structure for counting the number of glasses drunk daily will now be described by referring to FIGS. 1–6 of the drawing. The cup holder is generally designated numeral 10. It has a tubular body 12 having a top edge 14, a bottom edge 15 and a bottom wall 16. A pair of horizontal cutout slots 18 are formed in tubular body 12.

A C-shaped handle 20 is connected to tubular body 12. It has a top end 22 and a bottom end 23. Handle 20 has a counter assembly compartment 26 having a left side wall 27, a right side wall 28 and a rear wall 29 and a top wall 30 having an aperture 31. A window recess 34 is formed in left side wall 27 adjacent its top end for viewing the numbers on the disc 36.

Disc 36 has a front wall 38 and a rear wall 39. Numerals 0–10 are formed on front wall 38. A plurality of finger gripping protrusions 40 are formed around the perimeter of disc 36. A shaft 42 and a shaft 44 extend along an X-axis from the respective front and rear walls of the disc 36. A cutout slot 46 is formed in disc 36 and a flexible ratchet finger 48 extends partly into cutout slot 46. A dog or protrusion 50 extends from the end of ratchet finger 48 and it mates with the respective notches 54 formed on the inner end of annular boss 58 that extends inwardly from right side wall 28. A tubular boss 60 has a bore hole 62 that receives shaft 44. A tubular boss 66 extends inwardly from left side wall 27 and it has a bore hole 68 that receives shaft 42.

What is claimed is:

1. A cup holder with structure for counting the number of glasses of water drunk daily comprising:

a tubular body having an open top end for removably receiving a drinking cup;

said tubular body also having a top edge, a bottom edge, a front end and a rear end;

a handle having a counter assembly compartment, said handle being attached to said tubular body;

said counter assembly compartment having a left side wall, a right side wall, a rear wall, and a top wall having an aperture therein; said left side wall having an inner surface and a left side wall tubular boss extending inwardly therefrom and further having a tubular bore; said right side wall having an inner surface and a right side wall tubular boss extending inwardly therefrom and further having a bore hole; and a disk having a front wall, a rear wall and a peripheral edge; a series of numbers on said front wall, a first shaft extending from said front wall and a second shaft extending from said rear wall, said first shaft being journaled in the bore hole of said left side wall tubular boss and said second shaft being journaled in the bore hole of said right side wall tubular boss and said shaft together allow said disk to be rotated about an axis; the peripheral edge of said disk extending through said aperture in said top wall of said counter assembly compartment so that said disk can be rotated.

2. A cup holder as recited in claim 1 wherein said tubular body has a bottom wall.

3. A cup holder as recited in claim 1 in combination with a cup that is removably received in said tubular body.

4. A cup holder as recited in claim 1 wherein said handle has a C-shaped body.

5. A cup holder as recited in claim 4 wherein said tubular body has a plurality of horizontal slots for visually determining the amount of water remaining in a water cup.

6. A cup holder as recited in claim 1 further comprising means for locking said disc at predetermined rotational points.

* * * * *